US007666048B1

(12) United States Patent
Gibboney, Jr.

(10) Patent No.: US 7,666,048 B1
(45) Date of Patent: Feb. 23, 2010

(54) METHOD FOR SECURING A MINIATURE BULB IN A HOLDER

(75) Inventor: James W. Gibboney, Jr., Conyers, GA (US)

(73) Assignee: Tech Patent Licensing, LLC, St. Augustine, FL (US)

( * ) Notice: Subject to any disclaimer, the term of this patent is extended or adjusted under 35 U.S.C. 154(b) by 0 days.

(21) Appl. No.: 12/534,349

(22) Filed: Aug. 3, 2009

Related U.S. Application Data

(60) Provisional application No. 61/085,694, filed on Aug. 1, 2008.

(51) Int. Cl.
*H01J 9/24* (2006.01)
*H01J 9/00* (2006.01)

(52) U.S. Cl. ..... 445/23; 445/27; 362/654; 439/611

(58) Field of Classification Search ..... 445/23, 445/26–27, 29, 32; 362/226, 249, 653–654; 439/611, 619, 699.2
See application file for complete search history.

(56) References Cited

U.S. PATENT DOCUMENTS

| | | | | |
|---|---|---|---|---|
| 2,892,992 | A | | 6/1959 | Grovemiller et al. |
| 3,447,016 | A | | 5/1969 | Rycroft |
| 3,859,554 | A | | 1/1975 | Preziosi et al. |
| 3,963,822 | A | | 6/1976 | Beck et al. |
| 4,249,887 | A | * | 2/1981 | DeCaro et al. ..... 431/365 |
| 4,485,326 | A | | 11/1984 | Hellwig et al. |
| 4,573,754 | A | | 3/1986 | Hill |
| 4,763,038 | A | | 8/1988 | Takayama |
| 4,837,479 | A | | 6/1989 | Devir et al. |
| 4,950,942 | A | | 8/1990 | Braun et al. |
| 5,105,119 | A | | 4/1992 | Dayton |
| 5,126,631 | A | | 6/1992 | Golz |
| 5,161,881 | A | | 11/1992 | Myson |
| 5,221,140 | A | | 6/1993 | Oshino |
| 5,435,741 | A | | 7/1995 | Wang |
| 6,232,707 | B1 | | 5/2001 | Ranish et al. |
| 6,583,542 | B2 | | 6/2003 | Nagano et al. |
| 6,976,770 | B2 | | 12/2005 | Trimpe et al. |
| 7,210,808 | B2 | | 5/2007 | Malpetti |
| 7,220,022 | B2 | | 5/2007 | Allen et al. |
| 7,253,556 | B1 | * | 8/2007 | Gibboney ..... 313/318.01 |

* cited by examiner

*Primary Examiner*—Nimeshkumar D Patel
*Assistant Examiner*—Anne M Hines
(74) *Attorney, Agent, or Firm*—Michael A. Mann; Nexsen Pruet, LLC

(57) ABSTRACT

Miniature bulbs are secured in their holders against twisting by first forming holders with tapered cavities smaller at their bottoms than the bulb, then heating the holders to soften them prior to insertion of the bulb. When the bulb is fully seated and the holder has cooled and firmed up, the holder will conform to the exterior shape of the bulb including the irregularities in its surface caused by the bulb formation process. The snug fit of the holder to the irregularities in the bulb resist the twisting of the bulb.

4 Claims, 2 Drawing Sheets

METHOD FOR SECURING A MINIATURE BULB IN A HOLDER

CROSS REFERENCE TO RELATED PATENTS

The priority benefit of U.S. provisional patent application Ser. No. 61/085,694, filed Aug. 1, 2008, is claimed, which application is incorporated herein in its entirety by reference.

BACKGROUND OF THE INVENTION

In a single series light string of 100 miniature lights, there are numerous potential causes for the failure of any individual light. When several such strings are placed on a single Christmas tree, and that hundreds of millions of sets of lights are manufactured every year, reduction of the mechanisms that can cause light failure quickly becomes a high priority.

Miniature bulbs have two conductive wires called Dumet wires that extend from inside the glass bulb, where they connect to the ends of a filament, to the outside. These Dumet wires pass through holes in a bulb holder and are bent back around the outsides of the holder. The holder is then inserted into a lamp socket carrying two electrical terminals in opposing relation on the inside of the socket wall. When the holder is properly seated in the socket, the Dumet wires are in electrical contact with those electrical terminals and pass current from one terminal through the filament to the opposing terminal. If, however, the bulb is twisted with respect to the holder, the Dumet wires may break or may be retracted far enough back into the holder to be out of electrical contact with the terminals and to thereby open the circuit.

The twisting of the bulb with respect to the holder may happen accidentally, as when a person who is accustomed to bulbs that are threaded unconsciously attempts to twist the bulb in order to withdraw it from the socket, or intentionally, as when vandals deliberately twist individual bulbs to cause them to fail. Outside lighting displays are especially subject to vandalism, as vandals will twist a number of bulbs until the whole string fails.

There has been one known attempt to solve this problem of open circuits caused when bulbs are twisted with respect to the holder, namely, the use of adhesives to glue the bulbs to their holders. However, this solution has proved unsatisfactory as the thermal expansion coefficient of the plastic, particularly when the bulb is part of an outdoor display in winter, eventually causes the bulb to loosen from its holder notwithstanding the adhesive. Accordingly, there remains a need for a way to prevent inadvertent or intentional twisting of bulbs.

SUMMARY OF THE INVENTION

According to its major aspects and briefly recited, the present invention is a method of securing a miniature lamp of the type used in strings of lights for holiday decorating to its holder. The lamp includes a glass or plastic bulb with an internal filament and two electrically conducting Dumet wires extending from the interior of the bulb to its exterior, and a holder with a pair of through-holes that receive the Dumet wires and the bottom portion of the glass bulb. The method comprises the steps of forming a transparent bulb with irregular dimensions on the end of the bulb where the Dumet wires exit the bulb, forming a thermoplastic holder with a tapered interior cavity so that the largest part of the tapered cavity, the opening, is approximately the same size as the nominal diameter of the glass bulb to be inserted into it, and with two holes at the bottom of the cavity for the Dumet wires to extend through; heating the holder to soften the plastic; then inserting an end portion of the bulb from which the Dumet wires extend into the cavity of the holder while the holder plastic is still soft so that the bulb can easily deform the plastic and become fully seated with the Dumet wires extending through holes formed in the holder. As the plastic is allowed to cool, it conforms to the irregular surface of the bulb, securing the holder to the bulb. Then the Dumet wires are bent around the outsides of the cooled holder.

An important feature of the present invention is the interaction between the irregular exterior surface of the bulb and the tapered cavity of the holder that is narrower, for most of its length, than the bulb. The advantage of this feature is that the plastic holder, on cooling, conforms tightly to the irregular exterior surface of the bulb and thereby resists being twisted with respect to the holder. The irregularities of the bulb are departures from cylindrical symmetry. When the bulb is then seated in the tight grip of the cooled holder, and a torque is applied to the bulb, the irregularities interfere with material of the holder to thereby resist the rotation of the bulb.

Still another important feature of the present invention is the use of heat to facilitate insertion of the bulb into the holder. By heating the tapered plastic holder until it is soft, the plastic will be sufficiently pliable to give way as the bulb is inserted but to grip it tightly upon cooling as the plastic cools and conforms to the bulb. The heat thus allows the plastic to do what thermoplastic material does best, namely, deformably alter their shape to accommodate an irregular shape such as, in this case, the bulb both as it is being inserted into the smaller end of the holder cavity and as the warmed plastic flows back against the bulb during cooling.

These and other features and advantages of the present invention will be readily understood by those skilled in the art of manufacturing miniature bulbs from a careful reading of the Detailed Description of Preferred Embodiments, accompanied by the following drawings.

BRIEF DESCRIPTION OF THE DRAWINGS

In the figures.

DETAILED DESCRIPTION OF PREFERRED EMBODIMENTS

The present invention is a method for making a miniature lamp for use in the sockets of a string of lights, such as holiday decorative lighting used on Christmas trees. The present method results in a much higher torque being required to twist the bulb once it is in the socket, thereby essentially making it all but impossible for a person to accidentally or intentionally twist the bulb to cause an electrical short.

Figure 1:
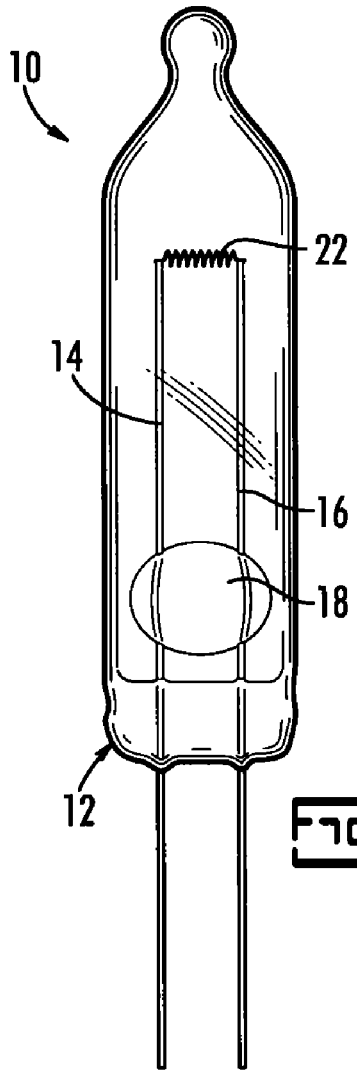
FIG. 1 is a side view of a bulb for a miniature lamp, according to a preferred embodiment of the present invention.

Referring now to the figures, the present bulb 10, best seen in FIG. 1, is at least translucent and preferably transparent, and has an irregular first end 12. Irregular means that the cross-section of bulb 10 along the major axis is not uniformly circular but departs from rotational symmetry by a few thousands of an inch around its circumference at least one point along its axis. Although the bulb has a nominal diameter, that is, is made to a pre-specified diameter, it has small variations from perfect rotational symmetry from point to point along that axis, particularly near the ends from which a pair of Dumet wires 14, 16, extend. Near Dumet wires 14, 16, where they exit first end 12 of bulb 10, molten glass may have collected and cooled so that small bulges appear around each Dumet wire 14, 16. Indeed, first end 12 may also have a bulge to one side of the axis or a lean away from the axis or have some other variation in its nominal diameter so that its geometry departs from an otherwise perfect cylinder through most of the length of bulb 10 but that ends in a perfect hemisphere at first end 12. The extent of the departure from nominal diameter need only be a few thousandths of an inch for the present invention to resist twisting of bulb 10.

Bulb 10 is made by beginning with a short length of tubing made of glass or other transparent or at least translucent material. Dumet wires 14, 16 are positioned with respect to each other and held in spaced relation by applying a non-conducting bead 18, preferably a glass bead applied as a molten drop of glass to the spaced Dumet wires. The Dumet wires are then attached to a filament 20 so as to run from one Dumet wire 14 to the other Dumet wire 16. Dumet wires 14, 16, bead 18 and filament 22 are inserted into first end 12 of the tube far enough so that Dumet wires 14, 16, are partially in the tube but also extend partially outside the tube at its first end 12. Then, the ends of the tube are sealed by melting the ends to thereby form bulb 10 with portions of Dumet wires 14, 16 extending from first end 12.

In this process, the irregularities are formed in first end 12 of bulb 10. These irregularities in the shape of first end 12 is a natural and inevitable result of the manufacture of making bulb 10, especially the melting and cooling of the ends of the tube around Dumet wires 14, 16, and is on the order of a few thousandths of an inch, sufficient for the present invention so that no additional irregularities are needed. To close the tube, the glass must be melted as additional glass added to first end 12 to seal it will cause a globular-shaped first end 12 of bulb 10 to form. The metal Dumet wires 14, 16, dissipate heat more quickly in their immediate vicinity and, together with imperfections in the glass such as microscopic bubbles and variations in the thickness of the glass tube inevitably cause sufficient deformities in the rotational symmetry of the end of the glass tube near Dumet wires 14, 16. Additional or greater irregularities do not have to be formed other than those that will be formed in the current process of making miniature bulbs.

Figure 2:
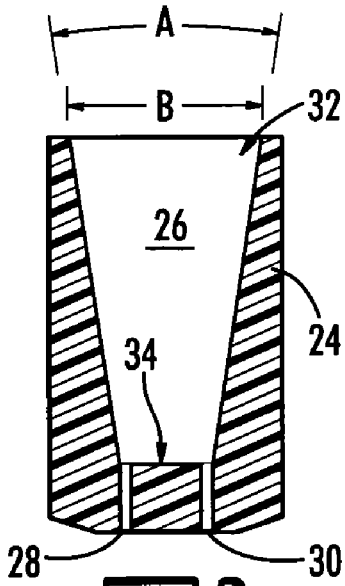
FIG. 2 is a side, cross-sectional view of a holder for a bulb, according to a preferred embodiment of the present invention.

FIG. 2 shows a cross-sectional view of a holder 24 made of plastic material and having a cavity 24 formed therein. Cavity 26 ends in two holes 28, 30, dimensioned to receive the portions of Dumet wires 14, 16, that extend outside of bulb 10. Cavity 26 is preferably smaller in diameter toward the bottom than the diameter of bulb 10, and most preferably has a larger first diameter B at its opening 32 than a second diameter at its bottom 34, most preferably having first diameter about the same size as the nominal diameter of bulb 10, and then tapering gradually from opening 32 to bottom 34 of cavity 26 so that the walls of cavity 26 are inclined at an angle A, preferably in the range 3-5 degrees off the major axis of cavity 26. The exterior dimensions of holder 24 may be the same as prior art holders.

Figure 3:
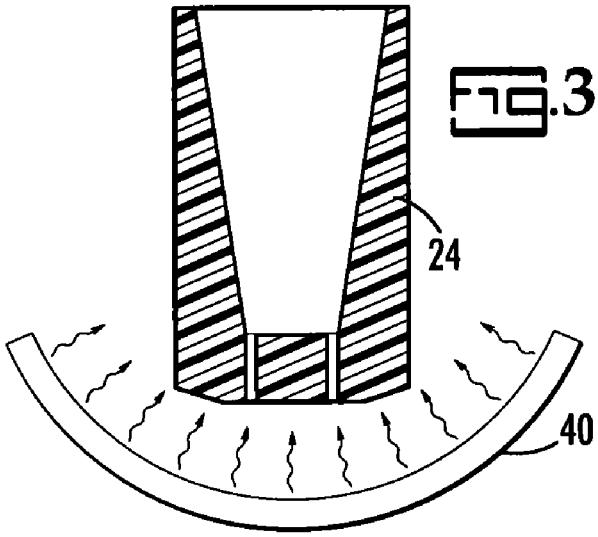
FIG. 3 is a schematic view of the holder in FIG. 2 being subjected to a source of heating to soften the lower portion thereof, according to a preferred embodiment of the present invention.

FIG. 3 is a schematic view of holder 24 being warmed by a heat source 40 to soften the thermoplastic material of which it is made prior to insertion of bulb 10. Source 40 can be any type of heat that softens thermoplastic materials in a controlled manner to a temperature at which they are pliable, such as a water bath, a source of radiative heat, or a source of warm air.

Figure 4:
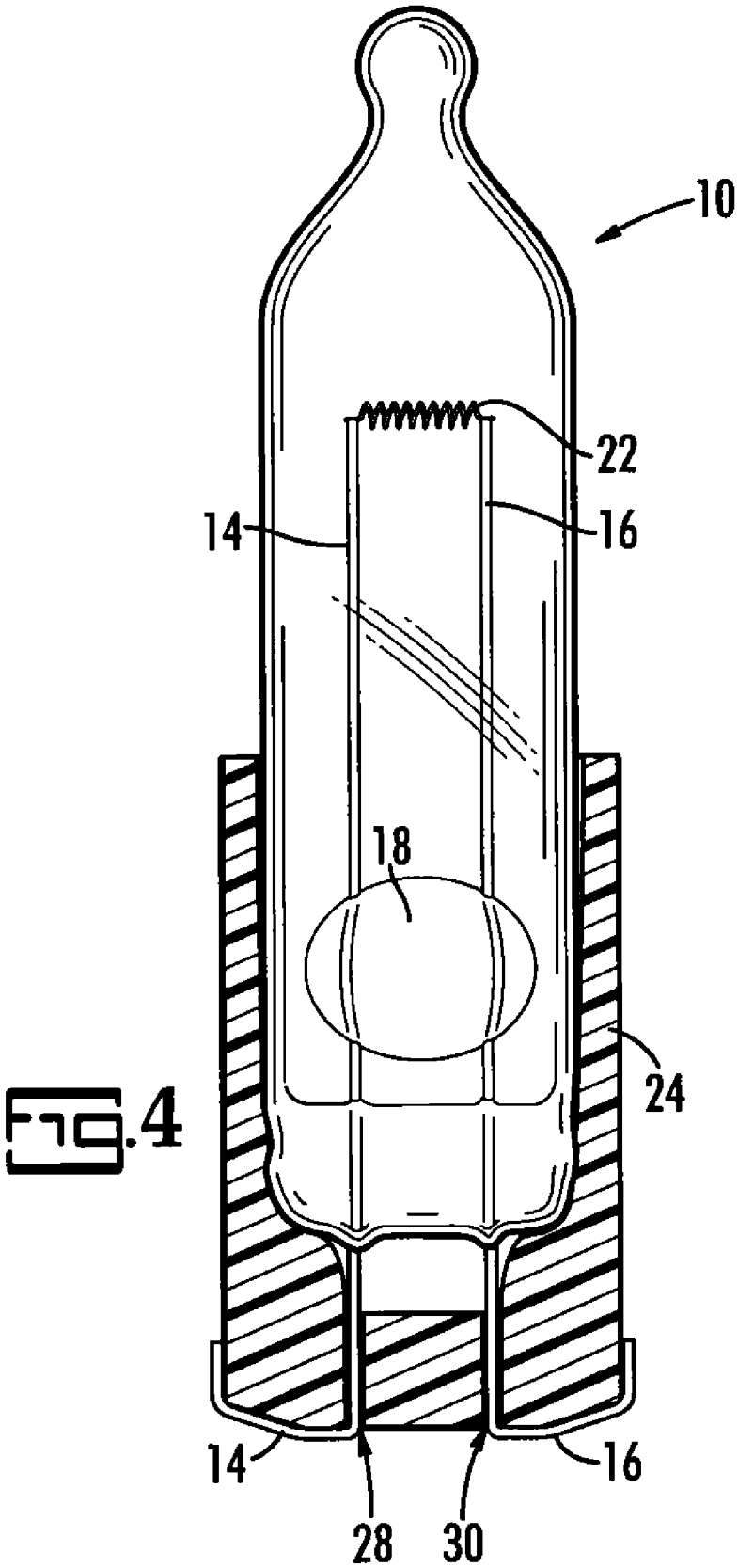
FIG. 4 is a side view of the miniature lamp with the holder shown in cross section, according to a preferred embodiment of the present invention.

Once holder 24 is sufficiently softened, that is, softened to the point where it will deform when pressure is applied to it, first end 12 of bulb 10 is inserted into tapered cavity 26 so that Dumet wires 14, 16, extend through holes 28, 30, respectively, and first portion 12 is fully seated on bottom 34 of tapered cavity 26. Holder 24 will deform easily as the bulb 10 is inserted and will conform to the irregular features of first portion 12 of bulb 10. Upon cooling, holder 24 will shrink as it firms up and thereafter hold bulb 10 tightly in a clinch fit in part because of its original taper but also because of the irregularities of the surface of bulb 10 to which holder 24 material will conform. See FIG. 4. Dumet wires 16, 18, where they have emerged from holes 28, 30, are then bent toward the outsides of holder 24.

A torque applied to bulb 10 with respect to holder 22 will have to be sufficiently large, probably large enough to break bulb 10, in order to twist bulb 10 from holder as each irregularity interferes with the material of holder 24. The amount of torque required would be too great for any accidental or intentional twisting to result in the shorting of bulb 10.

Those skilled in the art of manufacturing miniature lighting will understand that many substitutions and modifications can be made in the foregoing preferred embodiment without departing from the spirit and scope of the invention, as defined by the appended claims.

What is claimed is:

1. A method of making a miniature light, said method comprising the steps of:

(a) providing a tube, a filament, and two dumet wires, said tube having a first end and an opposing second end;

(b) applying a non-conductive bead to position and secure said two dumet wires in spaced relationship;

(c) attaching said filament across said dumet wires;

(d) inserting said dumet wires and filament partially into said first end of said tube so that said dumet wires partially extend from said first end outside of said tube;

(e) melting said first end and said second end of said tube so that said bead and said filament are inside said tube and said dumet wires extend from inside said tube to outside said tube at said first end, thereby forming a bulb, said bulb having a nominal diameter and rotational variations about said first end;

(f) forming a holder for said bulb, said holder being made of a thermoplastic material and having a cavity formed therein, said cavity having an opening with a first diameter, a bottom with a second diameter and two holes extending through said bottom of said cavity, said second diameter of said cavity being smaller than said first diameter and said second diameter being smaller than said nominal diameter of said bulb;

(g) heating said holder until said holder softens;

(h) inserting said dumet wires and said first end of said bulb into said softened holder until said first end of said bulb is seated on said bottom of said cavity and said dumet wires run through said holes and extend outside said holder; and (i) folding said dumet wires against said holder.

2. The method as recited in claim 1, wherein said cavity has an axis and wherein said cavity is tapered with respect to said axis.

3. The method as recited in claim 1, wherein said cavity has an axis and wherein said cavity is tapered at least 3% with respect to said axis.

4. The method as recited in claim 1, wherein said cavity has an axis and wherein said cavity is tapered not more than 5% with respect to said axis.

* * * * *